US007313874B2

(12) United States Patent
Park

(10) Patent No.: US 7,313,874 B2
(45) Date of Patent: Jan. 1, 2008

(54) DRYER AND METHOD FOR CONTROLLING THE SAME

(75) Inventor: Tae In Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/887,917

(22) Filed: Jul. 12, 2004

(65) Prior Publication Data

US 2005/0044743 A1 Mar. 3, 2005

(30) Foreign Application Priority Data

Aug. 26, 2003 (KR) ..... 10-2003-0059061
Aug. 26, 2003 (KR) ..... 10-2003-0059062

(51) Int. Cl.
*F26B 3/00* (2006.01)

(52) U.S. Cl. ..... 34/493; 34/495; 34/87; 34/89; 34/562; 34/572

(58) Field of Classification Search ..... 34/543, 34/544, 562, 572, 495, 493, 87–89; 219/722
See application file for complete search history.

(56) References Cited

U.S. PATENT DOCUMENTS 2,903,799 A * 9/1959 Sachaczenski ..... 34/527
4,206,552 A * 6/1980 Pomerantz et al. ..... 34/445
4,785,152 A * 11/1988 Hirata et al. ..... 219/719
5,483,045 A * 1/1996 Gerling ..... 219/722
6,154,978 A * 12/2000 Slutsky ..... 34/321

* cited by examiner

*Primary Examiner*—Kenneth Rinehart
(74) *Attorney, Agent, or Firm*—McKenna Long & Aldridge LLP

(57) ABSTRACT

A dryer is disclosed. The dryer includes dryer includes a door opening sensing unit sensing an opening of a door, a heater heating air provided in a drum, and a microcomputer determining an error in the heater based on an internal temperature condition of the drum, which changes in accordance with a driving time of the heater, and setting a new driving time of the heater, when the door is open before the driving time of the heater being counted reaches a predetermined driving time.

6 Claims, 5 Drawing Sheets

DRYER AND METHOD FOR CONTROLLING THE SAME

CROSS-REFERENCE TO RELATED APPLICATIONS

This application claims the benefit of Korean Application Nos. P2003-059061, filed on Aug. 26, 2003, and P2003-059062, filed on Aug. 26, 2003, which are hereby incorporated by reference as if fully set forth herein.

BACKGROUND OF THE INVENTION

1. Field of the Invention

The present invention relates to a dryer, and more particularly, to a dryer and a method for controlling the same. Although the present invention is suitable for a wide scope of applications, it is particularly suitable for controlling the dryer when a door thereof is open and when a drum thereof comes into physical contact with a user.

2. Discussion of the Related Art

A dryer is a machine for drying damp washed clothes by using heated air. A structure of a general dryer will now be described in detail. Referring to FIG. 1, a drum 2 is fixed within a case 1, and an opening 3 for inputting washed clothes into the drum 2 is formed on a front surface of the case 1. A door 4 that can be opened and closed is fixed to the opening 3.

A motor 5 for rotating the drum 2 is formed on an upper portion inside the case 1. The motor 5 transmits a rotating force to the drum 2 through a belt 6 for drums. A plurality of wings 7 is formed on an inner wall of the drum 2 so as to stir the washed clothes when the drum 2 is rotated. A circulation duct 8 for circulating the air within the drum 2 is formed below the drum 2. And, in order to provide hot air to the drum 2, a heater 11 for heating air is provided between the drum 2 and the circulation duct 8. A fan 9 for exhausting the air within the drum 2 is formed behind the drum 2. The fan 9 rotates by receiving a driving force from the motor 5 through the belt 10. A supply duct 11 supplying ambient air to the circulation duct 8 and a condensed water discharge duct 13 for discharging condensed water, which is produced during the circulation of the air, to the outside are connected to the circulation duct 8.

When the door 4 is open during the drying cycle, ambient air is flown into the drum 2, and after the door 4 is closed, the dryer resumes the drying cycle. At this point, the temperature condition inside the drum 2 is abruptly changed, thereby preventing the washed clothes from being completely dried. Also, in case of large capacity dryers, when a child puts himself or herself inside the drum, the dryer cannot sense the presence of the child, which may result in accidents caused by carelessness.

SUMMARY OF THE INVENTION

Accordingly, the present invention is directed to a dryer and a method for controlling the same that substantially obviate one or more problems due to limitations and disadvantages of the related art.

An object of the present invention is to provide a dryer and a method for controlling the same that can reset a driving time of the heater, when the door of the dryer is open during a drying cycle, while taking various external factors into consideration.

Another object of the present invention is to provide a dryer and a method for controlling the same that can prevent accidents caused by carelessness.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dryer includes a door opening sensing unit sensing an opening of a door, a heater heating air provided in a drum, and a microcomputer determining an error in the heater based on an internal temperature condition of the drum, which changes in accordance with a driving time of the heater, and setting a new driving time of the heater, when the door is open before the driving time of the heater being counted reaches a predetermined driving time.

Herein, the microcomputer provides an alarm or a message to a user, so as to inform the user of an error occurring in the heater, and the microcomputer sets a new driving time of the heater based on the counted driving time of the heater. Also, the microcomputer either sets a new driving time of the heater based on an internal temperature condition of the drum, or compares the internal temperature condition of the drum with a plurality of reference internal temperature conditions and sets a new driving time of the heater based on the compared value.

In another aspect of the present invention, a method for controlling a dryer includes initially setting a driving time of a heater, the heater heating air provided in a drum, sensing whether a door of the dryer is open during the initially set driving time, and setting a new driving time of the heater, if the door of the dryer is open during the initially set driving time, and determining whether an error is occurring based on an internal temperature condition, which changes in accordance with the driving time of the heater.

Herein, the initially setting a driving time of a heater includes initially setting a driving time of the heater in accordance with an amount or a type of clothes to be dried.

Also, the setting a new driving time of the heater includes setting a new driving time of the heater in accordance with an internal temperature condition of the drum. Moreover, the setting a new driving time of the heater in accordance with an internal temperature condition of the drum includes comparing the internal temperature condition of the drum with a plurality of reference temperature conditions, and setting a new driving time of the heater in accordance with the compared result.

The setting a new driving time of the heater includes setting a new driving time of the heater in accordance with a processed driving time of the heater.

In another aspect of the present invention, a dryer includes a heater heating air provided in a drum, a sensor sensing whether a human body is in physical contact with a drum, and a microcomputer stopping a driving of the heater and a rotation of the drum, when the human body comes into physical contact with the drum.

Herein, the sensor senses a change in electrostatic capacity of the drum.

The microcomputer outputs an alarm or a warning message and opens a door of the dryer, when the human body comes into physical contact with the drum. At this point, the microcomputer also discharges air within the drum.

In a further aspect of the present invention, a method for controlling a dryer includes sensing whether a human body comes into physical contact with a drum, and stopping a driving of the heater and a rotation of the drum, when the human body comes into physical contact with the drum.

The method for controlling the dryer further includes opening a door of the dryer and discharging air within the drum, when the human body comes into physical contact with the drum.

Herein, the sensing whether a human body comes into physical contact with a drum includes detecting a changed amount of electrostatic capacity of the drum, comparing the detected changed amount of electrostatic capacity with a reference changed amount, and determining whether the human body comes into physical contact with the drum depending upon the compared result.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First Embodiment

Figure 1:
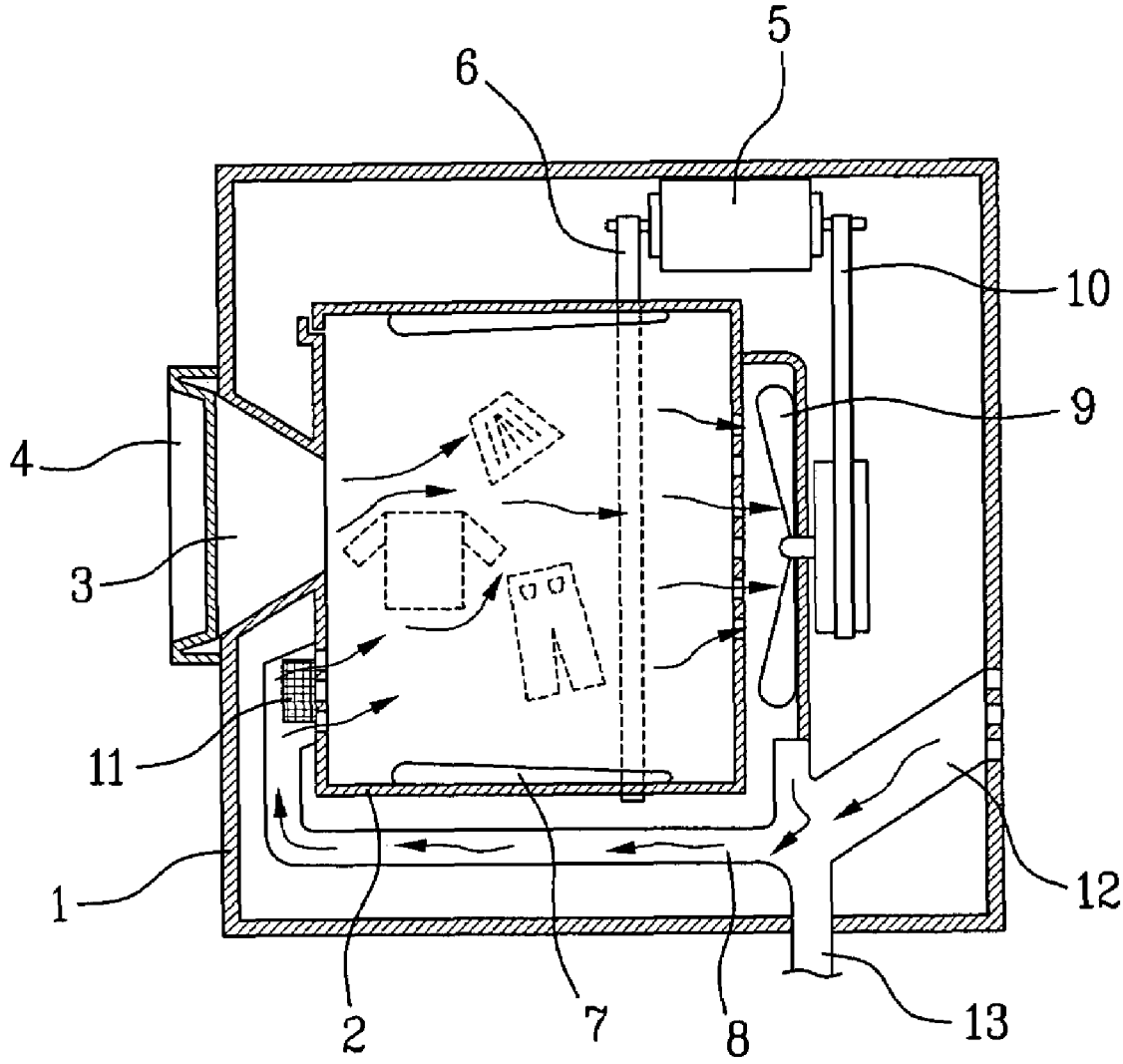
FIG. 1 Background Art
FIG. 1 illustrates a general dryer.
Figure 2:
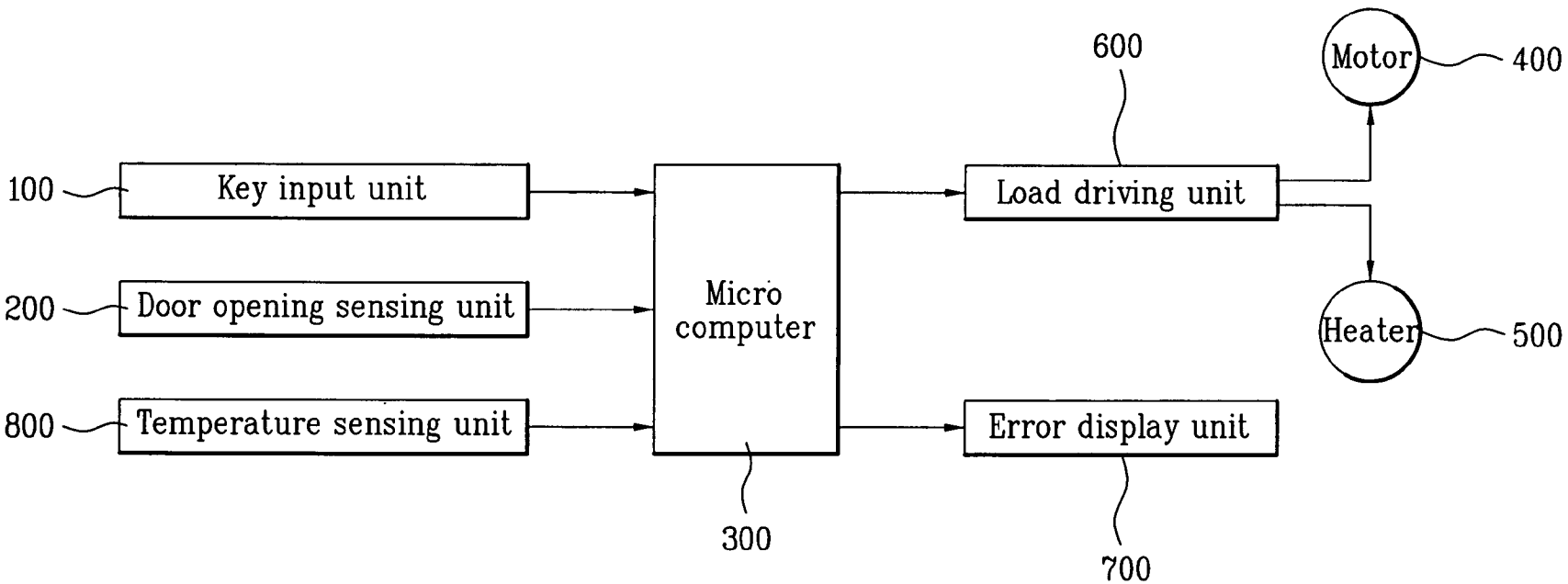
FIG. 2 illustrates a block diagram showing the structure of a dryer according to a first embodiment of the present invention.
Figure 3:
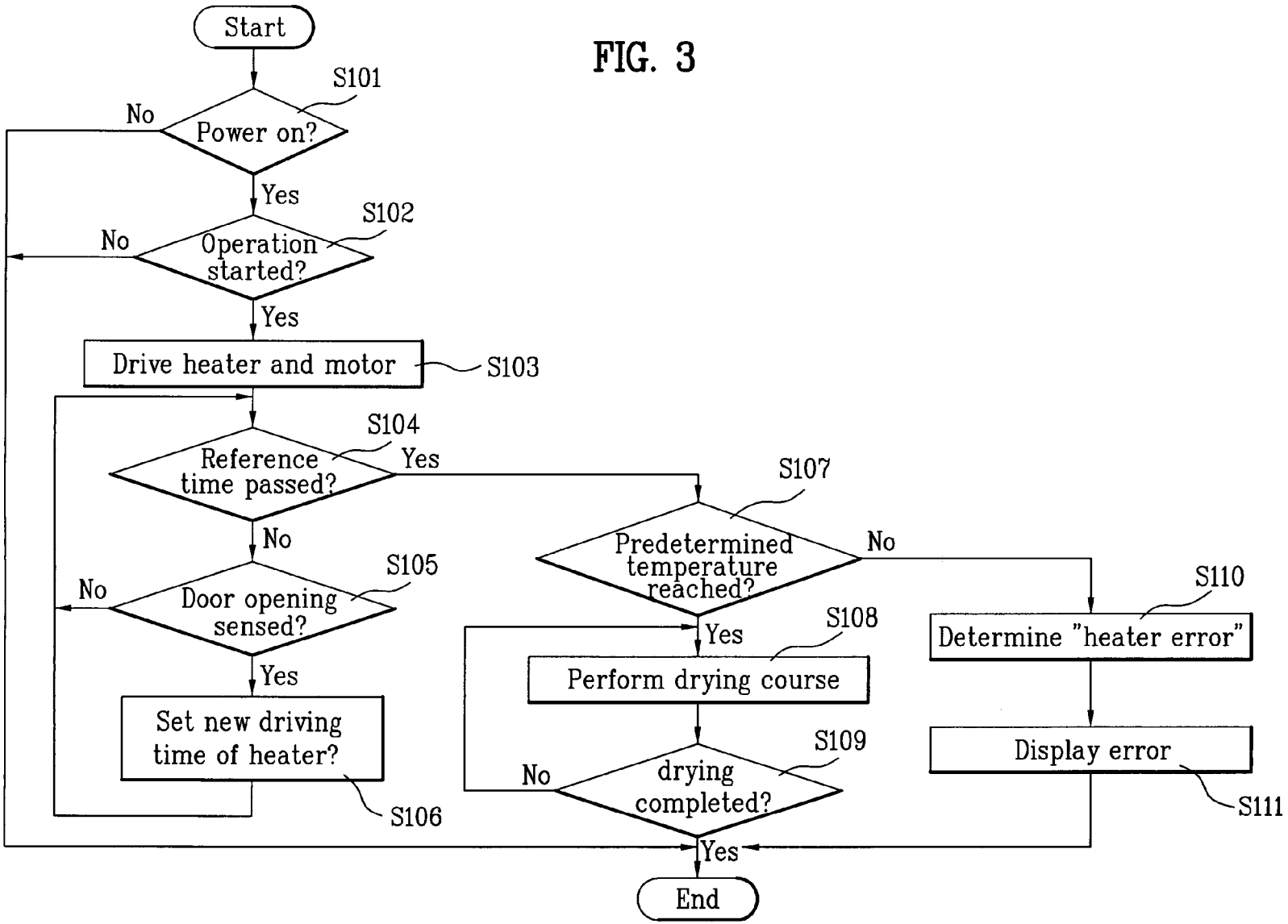
FIG. 3 illustrates a flow chart showing the process steps of controlling the dryer according to the first embodiment of the present invention.

FIG. 2 illustrates a block diagram showing the structure of a dryer according to a first embodiment of the present invention. Referring to FIG. 2, the dryer according to the present invention includes a key input unit 100 for inputting user command, a motor 400 for rotating a drum, a heater 500 for heating air provided in the drum, a load driving unit 600 for driving the motor 400 and the heater 500 according to the user command, a door opening sensing unit 200 for sensing the door (numeral 4 of FIG. 1) of the dryer being open, a microcomputer 300 resetting the driving time of the heater 500, when the door opening sensing unit 200 senses the door being open, and re-counting the time, an error display unit 700 displaying any error occurring in a unit of the dryer, such as the heater, in accordance with the control of the microcomputer 300, and a temperature sensing unit 800 sensing the temperature condition within the drum (numeral 2 of FIG. 1) of the dryer.

The method for controlling the dryer according to the present invention will now be described in detail. The user selects a course or an option for drying washed clothes through the key input unit 100, for example, a driving time of the heater 500 depending upon the amount or type of the washed clothes, or a heating level of the heater 500. Alternatively, the microcomputer 300 can automatically set up driving time of the heater 500 and the heating level of the heater 500 depending upon the amount or type of the washed clothes to be dried. Also, when the user inputs a "start" command, the microcomputer 300 drives the motor 400 and the heater 500 in accordance with the selected course or option (S101 to S103).

When the heater 500 is driven, the microcomputer 300 begins to count the driving time of the heater 500 and periodically determines as to whether the driving time being counted is equal to a predetermined driving time of the motor 500 (S104). If the door is open before the driving time being counted reaches the predetermined driving time (S105), then the microcomputer 300 stops the driving of the heater 500 and sets up a new driving time of the heater 500 (S106). When the door opens during the drying cycle, the temperature condition within the drum may be decreased due to the inflow of ambient air. If the driving time of the heater 500 is not reset, then the damp clothes may not be completely dried and the controller (or microcomputer) 300 may determine that an error has occurred in the heater 500. Therefore, the microcomputer 300 sets up a new driving time of the heater 500 depending upon the previously counted driving time or the measured temperature condition within the drum. More specifically, if the previously counted driving time is long, then the newly set driving time is relatively shorter, and if the previously counted driving time is short, then the newly set driving time is relatively longer. Additionally, if the measured temperature condition within the drum is high, then the new driving time of the heater 500 is set to be short, and if the measured temperature condition within the drum is low, then the new driving time of the heater 500 is set to be long. Evidently, the newly set driving time of the heater 500 can also be decided in accordance with a comparison result after comparing the temperature condition within the drum with reference temperatures. Accordingly, the microcomputer 300 restarts the driving of the heater 500 for a newly set driving time, and the counting of the driving time of the heater 500 is also restarted.

The temperature sensing unit 800 constantly senses the internal temperature condition of the drum. The microcomputer 300 determined the error in the heater 500 based on the change in the internal temperature condition of the drum as the driving time of the heater 500 is being processed (S107). For example, when the internal temperature condition of the drum is lower than the predetermined temperature by the time the driving time of the heater 500 reaches the predetermined driving time, the microcomputer 300 determines that an error has occurred in the heater 500 (S110). Then, the microcomputer 300 either displays a message on the error display unit 700 or sets off an alarm in order to notify the user of the error in the heater 500 (S111). On the other hand, when the internal temperature condition of the drum reaches the predetermined temperature level, the microcomputer 300 determines that the heater 500 is operating normally and ends the drying cycle.

Second Embodiment

Figure 4:
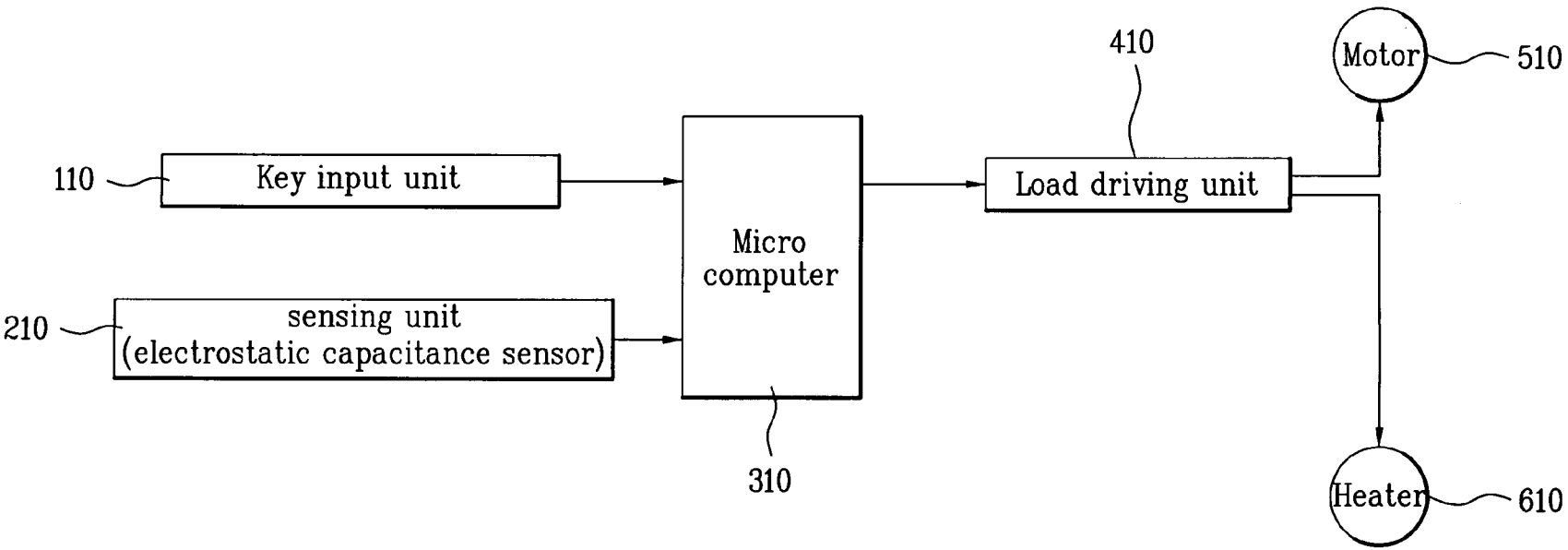
FIG. 4 illustrates a block diagram showing the structure of a dryer according to a second embodiment of the present invention.

FIG. 4 illustrates a block diagram showing the structure of a dryer according to a second embodiment of the present invention. Referring to FIG. 4, the dryer includes a key input unit 110 for inputting user command, a motor 510 for rotating a drum, a heater 610 for heating air provided in the drum, a sensor 210 for sensing physical contact of the drum with a human body, a microcomputer 310 stopping the rotation of the motor 510 and the driving of the heater 610, when the sensor 210 senses a human body being in physical contact with the drum, and a load driving unit 410 for driving the motor 510 and the heater 610 according to the controls of the microcomputer 310.

The sensor 210 is an electrostatic capacity detecting sensor detecting the amount of electrostatic capacity of the drum, which is mounted on an inner wall of the drum. The drum is formed of a metal, such as aluminum, and so, the sensor 210 can sense a human body physically contacting the drum based on a change in the electrostatic capacity of the drum. The microcomputer 310 verifies a changed amount of electrostatic capacity of the drum from the sensor 210 and, then, compares the changed amount of electrostatic capacity with a reference amount of electrostatic capacity. If the changed amount of the electrostatic capacity exceeds the reference changed amount, the microcomputer 310 determined that a human body is in physical contact with the drum.

Figure 5:
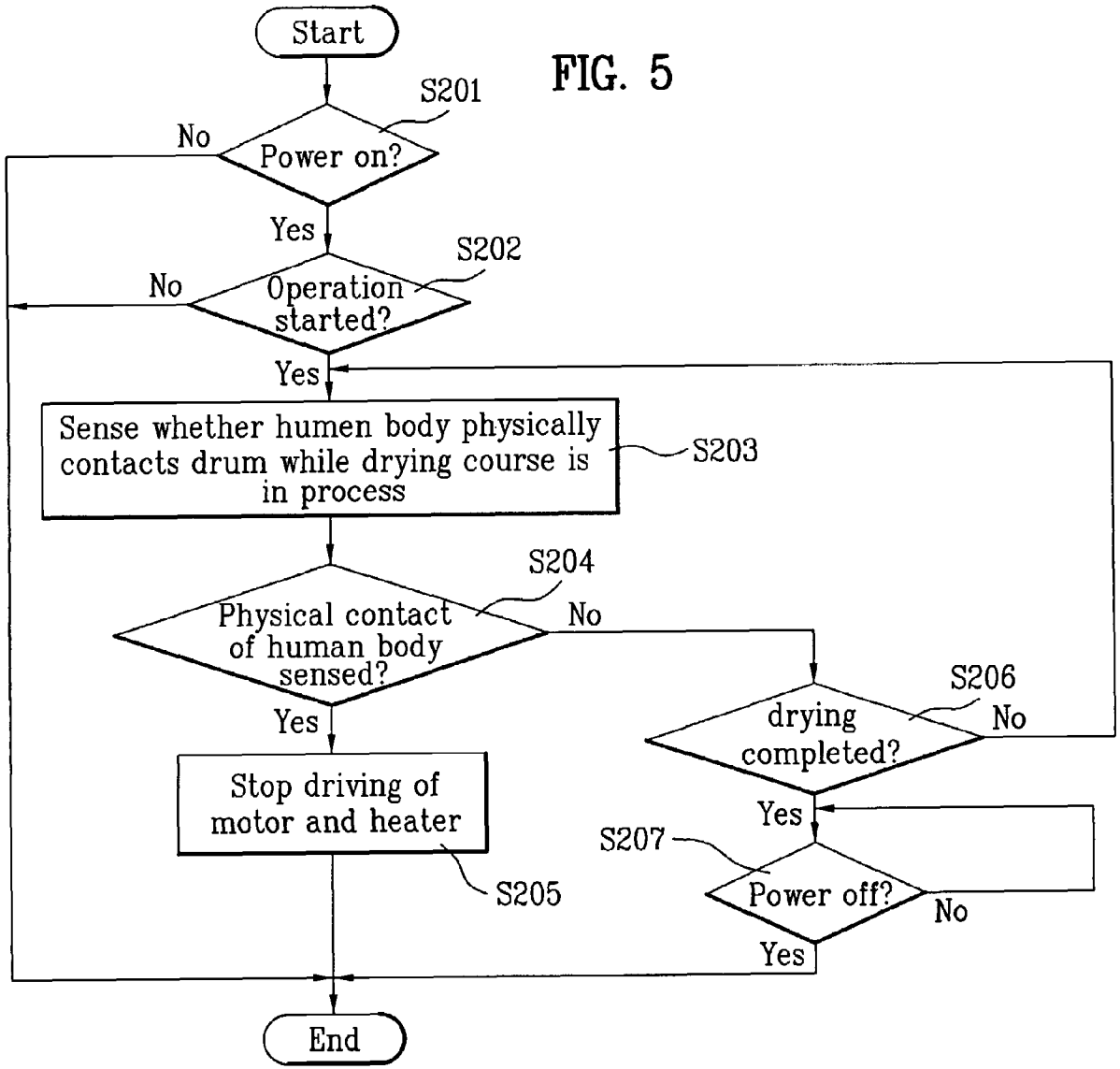
FIG. 5 illustrates a flow chart showing the process steps of controlling the dryer according to the second embodiment of the present invention.

A method for controlling the dryer according to the second embodiment of the present invention will now be described in detail. FIG. 5 illustrates a flow chart showing the process steps of the method for controlling the dryer in accordance with the second embodiment of the present invention. Referring to FIG. 5, a user turns on the dryer (S201), and then the user selects a course or an option for drying washed clothes through the key input unit 110, for example, a driving time of the heater 610 depending upon the amount or type of the washed clothes, or a heating level of the heater 610. Alternatively, the microcomputer 310 can automatically set up driving time of the heater 610 and the heating level of the heater 610 depending upon the amount or type of the washed clothes to be dried. Also, when the user inputs a "start" command (S202), the microcomputer 310 drives the motor 510 and the heater 610 in accordance with the selected course or option.

When the dryer is turned on, the sensor 210 senses whether a human body is in physical contact with the drum. If there is no physical contact in the drum, the microcomputer 310 drives the motor 510 and the heater 610 in accordance with the selected course or option, thereby performing the drying cycle. Also, the senor 210 sense whether a human body is in physical contact with the drum, even while the drying course is in process (S203).

If a physical contact with a human body occurs during the drying cycle (S204), the microcomputer 310 controls the load driving unit 410, so as to stop the driving of the motor 510 and the heater 610. Accordingly, the load driving unit 410 shuts down the power supplied to the motor 510 and the heater 610 based on the control of the microcomputer 310 (S205). Then, the microcomputer 310 opens the door in order to discharge the heated air within the drum to the outside of the dryer. Thereafter, the microcomputer 310 sets off an alarm or displays a warning message on a display unit (not shown).

On the other hand, if a physical contact with a human, body does not occur during the drying cycle, the microcomputer 310 drives the motor 510 and the heater 610 normally. Nevertheless, the microcomputer 310 constantly verifies whether the drum comes into a physical contact with a human body at any random time during the course of the drying cycle.

As described above, the dryer according to the present invention has the following advantages.

By resetting a driving time of a heater when the door of the dryer is open during the course of a drying cycle, the drying efficiency for damp washed clothes that are to be dried can be enhanced. Also, by sensing the internal temperature condition of the drum, a microcomputer can accurately control the operation of the heater in accordance with the change in the temperature conditions. Finally, the dryer according to the present invention can detect any physical contact of the drum with a human body, thereby preventing accidents caused by carelessness.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a dryer, comprising:

initially setting a driving time for a heater, the heater heating air provided in a drum;

sensing whether a door of the dryer is open during the initially set driving time;

setting a new driving time of the heater, if the door is open during the initially set driving time; and determining whether an error is occurring based on an internal temperature condition, which changes in accordance with the driving time of the heater.

2. The method according to claim 1, wherein initially setting a driving time of a heater comprises initially setting a driving time of the heater in accordance with an amount or a type of clothes to be dried.

3. The method according to claim 1, wherein setting a new driving time of the heater comprises resetting the new driving time of the heater in accordance with an internal temperature condition of the drum.

4. The method according to claim 3, wherein resetting the driving time of the heater in accordance with an internal temperature condition of the drum comprises:

comparing the internal temperature condition of the drum with a plurality of reference temperature conditions; and resetting the driving time of the heater in accordance with the compared result.

5. The method according to claim 1, wherein setting a new driving time of the heater comprises setting the new driving time of the heater in accordance with a processed driving time of the heater.

6. The method according to claim 1, further comprising outputting an alarm or a warning message so as to inform a user of an error in the heater.

* * * * *